US009653859B1

(12) United States Patent
Moore et al.

(10) Patent No.: US 9,653,859 B1
(45) Date of Patent: May 16, 2017

(54) ELECTRICAL CONNECTOR SYSTEM

(71) Applicant: Delphi Technologies, Inc., Troy, MI (US)

(72) Inventors: Brandon M. Moore, Austintown, OH (US); Eric E. Shasteen, Salem, OH (US); Don E. Bizon, Boardman, OH (US); Ryan E. White, Cortland, OH (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 15/095,515

(22) Filed: Apr. 11, 2016

(51) Int. Cl.
*H01R 24/38* (2011.01)
*H01R 4/18* (2006.01)
*H01R 13/422* (2006.01)
*H01R 103/00* (2006.01)

(52) U.S. Cl.
CPC ..... *H01R 24/38* (2013.01); *H01R 4/183* (2013.01); *H01R 13/422* (2013.01); *H01R 2103/00* (2013.01)

(58) Field of Classification Search
CPC ..... H01R 31/02; H01R 11/12; H01R 11/32; H01R 24/28
USPC ..... 439/721, 723
See application file for complete search history.

(56) References Cited

U.S. PATENT DOCUMENTS 3,263,202 A * 7/1966 Dean ..... H01R 31/02 439/724
4,795,379 A * 1/1989 Sasaki ..... H01R 13/11 439/856
4,884,050 A 11/1989 Kozel et al.
5,052,951 A * 10/1991 Johnson ..... H01R 31/02 439/723
5,322,445 A * 6/1994 Ozaki ..... B60R 16/02 439/212
6,257,938 B1 * 7/2001 Day ..... H01R 13/6272 439/721
6,302,709 B1 * 10/2001 Ross ..... H01R 4/34 439/78
6,315,621 B1 * 11/2001 Natori ..... H01R 13/2428 439/862
6,382,999 B1 * 5/2002 Mou ..... H01R 13/7032 200/51.09
6,402,571 B1 * 6/2002 Muller ..... H01R 13/18 439/745
6,527,590 B2 * 3/2003 Oguchi ..... G06K 7/0021 439/630
6,969,285 B2 * 11/2005 Kobayashi ..... H01R 9/223 439/723

(Continued)

*Primary Examiner* — Ross Gushi
(74) *Attorney, Agent, or Firm* — Robert J. Myers

(57) ABSTRACT

An electrical connector system including a male connector having a male terminal that defines a first blade longitudinally projecting from the male terminal and a second blade longitudinally projecting from the same male terminal. A first blade width is less than a second blade width and a first blade length is less than a second blade length. The male terminal further defines a pair of crimp wings configured to attach the male terminal to a wire cable. The system further includes a female connector having a first female terminal configured to receive the first blade and a second female terminal configured to receive the second blade, thereby electrically interconnecting the first female terminal, the second female terminal, and the wire cable.

17 Claims, 5 Drawing Sheets

(56) References Cited

U.S. PATENT DOCUMENTS 6,997,751 B2 * 2/2006 Miyamoto ..... H01R 13/2464 439/630
7,114,989 B2 * 10/2006 Yin ..... H01R 24/50 439/578
7,134,893 B1 * 11/2006 Kalisz ..... H01R 11/12 439/287
7,267,583 B1 9/2007 Smith
7,338,329 B2 * 3/2008 Yang ..... H01R 24/58 439/188
7,762,857 B2 * 7/2010 Ngo ..... H01R 13/112 439/747
7,892,034 B2 * 2/2011 Maiterth ..... G06K 7/0021 439/630
7,905,731 B2 * 3/2011 Ngo ..... H01R 12/585 439/75
8,100,730 B2 * 1/2012 Hara ..... H01R 4/64 439/721
8,157,590 B2 * 4/2012 Yamakami ..... H01R 23/688 439/607.05
8,563,862 B2 * 10/2013 Mochizuki ..... H01R 4/26 174/68.2
8,651,893 B2 * 2/2014 Ogura ..... H01R 12/716 439/260
8,920,201 B2 * 12/2014 Byrne ..... H01R 4/48 439/861
9,033,750 B2 * 5/2015 Miller ..... H01R 13/26 439/862
9,054,508 B2 * 6/2015 Yamamoto ..... H01R 13/113
9,118,121 B2 * 8/2015 Yamamoto ..... H01R 4/18
9,211,852 B2 * 12/2015 Omori ..... H01R 4/64
9,236,678 B2 * 1/2016 Joo ..... H01R 13/2457
9,300,093 B2 * 3/2016 Omori ..... H01R 4/64
9,362,665 B2 * 6/2016 Omori ..... H01R 4/64
9,466,907 B2 * 10/2016 Sakaue ..... H01R 24/60
2002/0081916 A1 * 6/2002 Wertz ..... H01R 13/115 439/856
2002/0098740 A1 * 7/2002 Ooya ..... G06K 7/0021 439/630
2011/0039458 A1 * 2/2011 Byrne ..... H01R 11/22 439/861
2012/0298418 A1 * 11/2012 Mochizuki ..... H01R 4/26 174/84 C

* cited by examiner

ELECTRICAL CONNECTOR SYSTEM

TECHNICAL FIELD OF THE INVENTION

The invention relates to an electrical connector systems, in particular to an electrical connector system configured to interconnect more than two high voltage electrical loads.

BACKGROUND OF THE INVENTION

Shielded wire cables typically include an insulated center conductor and a separate insulated shield conductor surrounding the center conductor insulation. The shield conductor may consist of a braided wire mesh, metal foil, or metalized film. The cables typically have a second insulation layer covering the shield conductor. Shielded wire cables have been long used for communications systems, such as in cable television transmission lines. Shielded wire cables are also finding use in high voltage applications in electric and hybrid electric vehicles. When shielded wire cables are spliced together, there is usually a need to electrically connect the shield conductors of the spliced cables as well as the center conductor, in order to maintain electrical continuity of the shield conductors. Interconnecting the shield conductors may be complicated because the shield conductors must be cut back from the spliced ends of the cable in order to join the center conductors. Interconnecting the shield conductors may be further complicated in a one-to-many splicing configuration, sometimes referred to as a Y-splice.

FIG. 1 illustrates a prior art scheme for connecting a number of electrical loads 1 to a battery pack 2, such as in an electric vehicle (not shown). Each electrical load 1 requires a pair of high voltage shielded wire cables (positive polarity 3 and negative polarity 4) running from the battery pack 2 to the electrical load 1 and a separate fuse 5 protecting each of the circuits.

The subject matter discussed in the background section should not be assumed to be prior art merely as a result of its mention in the background section. Similarly, a problem mentioned in the background section or associated with the subject matter of the background section should not be assumed to have been previously recognized in the prior art. The subject matter in the background section merely represents different approaches, which in and of themselves may also be inventions.

BRIEF SUMMARY OF THE INVENTION

In accordance with a first embodiment of the invention, a male electrical terminal is provided. This terminal includes a connection portion that defines a first blade longitudinally projecting from the terminal and a second blade also longitudinally projecting from the terminal. A width of the first blade is less than a width of the second blade. A length of the first blade is less than a length of the second blade. The terminal also includes an attachment portion that defines a pair of crimp wings that are configured to attach the terminal to a wire cable. The terminal further includes a transition portion intermediate the connection portion and the attachment portion.

The transition portion may define a first shoulder that laterally projects from a first mesial edge of the transition portion that is proximate the first blade. The transition portion may further define a second shoulder that laterally projects from a second mesial edge of the transition portion that is located opposite the first mesial edge. This second shoulder is proximate the second blade. A width of the first shoulder may be greater than a width of the second shoulder. A distal region of the transition portion may define an aperture that is characterized as having a generally rectangular shape.

In accordance with a second embodiment of the invention, an electrical connector system is provided. The electrical connector system includes a male connector having a male terminal that defines a first blade that longitudinally projects from the male terminal and a second blade that also longitudinally projects from the male terminal. A width of the first blade is less than a width of the second blade. A length of the first blade is less than a length of the second blade. The male terminal further defines a pair of crimp wings that are configured to attach the male terminal to a wire cable. The electrical connector system also includes a female connector having a first female terminal that is configured to receive the first blade of the male terminal and a second female terminal configured to receive the second blade of the male terminal, thereby electrically interconnecting the first female terminal, the second female terminal, and the wire cable.

The first blade may define a first shoulder that laterally projects from a mesial edge of the first blade and the second blade may define a second shoulder that laterally projects from another mesial edge of the second blade. A width of the first shoulder may be greater than a width of the second shoulder.

The electrical connector system may further include a male connector body that defines a cavity configured to receive the male terminal. This cavity defines a first longitudinal slot that is configured to receive the first shoulder and defines a second longitudinal slot located opposite the first slot. The second slot has depth that is less than a depth of the first slot. The second slot is configured to receive the second shoulder. A lateral edge of the first shoulder is configured to engage an end wall of the first slot and a lateral edge of the second shoulder is configured to engage another end wall of the second slot.

A distal region of the male terminal may define an aperture. The male connector body may define a snap feature that is configured to engage this aperture. The aperture may be characterized as having a rectangular shape.

In accordance with a third embodiment of the invention, another electrical connector system is provided. The electrical connector system includes a male connector having a male terminal that defines a first blade that longitudinally project from the male terminal and a second blade that also longitudinally projects from the male terminal. A width of the first blade is less than a width of the second blade. The male terminal further defines a pair of crimp wings that are configured to attach the male terminal to a wire cable. The electrical connector system further includes a female connector having a first female terminal which is configured to receive the first blade and a second female terminal that is configured to receive the second blade. A first tip of the first blade has a first relative position and a second tip of the second blade has a second relative position that is different than the first relative position such that as the male connector is mated with the female connector, the first tip does not contact the first female terminal at the same time that the second tip contacts the second female terminal, thereby lowering a peak engagement force required to mate the male connector with the female connector. In addition, the first female terminal, the second female terminal, and the wire cable are electrically interconnected as the male connector is mated with the female connector. According to one particular embodiment, the peak engagement force required for mating the male connector with the female connector does not exceed 75 newtons.

The first blade may define a first shoulder that laterally projects from a mesial edge of the first blade and the second blade may define a second shoulder that laterally projects from another mesial edge of the second blade. A width of the first shoulder may be greater than a width of the second shoulder.

The electrical connector system may further include a male connector body that defines a cavity which is configured to receive the male terminal. This cavity defines a first longitudinal slot that is configured to receive the first shoulder and defines a second longitudinal slot located opposite the first slot. The second slot has depth that is less than a depth of the first slot. The second slot is configured to receive the second shoulder. A lateral edge of the first shoulder is configured to engage an end wall of the first slot and a lateral edge of the second shoulder is configured to engage another end wall of the second slot.

A distal region of the male terminal may define an aperture. The male connector body may define a snap feature that is configured to engage this aperture. The aperture may be characterized as having a rectangular shape.

BRIEF DESCRIPTION OF THE SEVERAL VIEWS OF THE DRAWING

The present invention will now be described, by way of example with reference to the accompanying drawings, in which.

DETAILED DESCRIPTION OF THE INVENTION

A male electrical terminal and an electrical connection system employing this male electrical terminal is presented herein.

Figure 2:
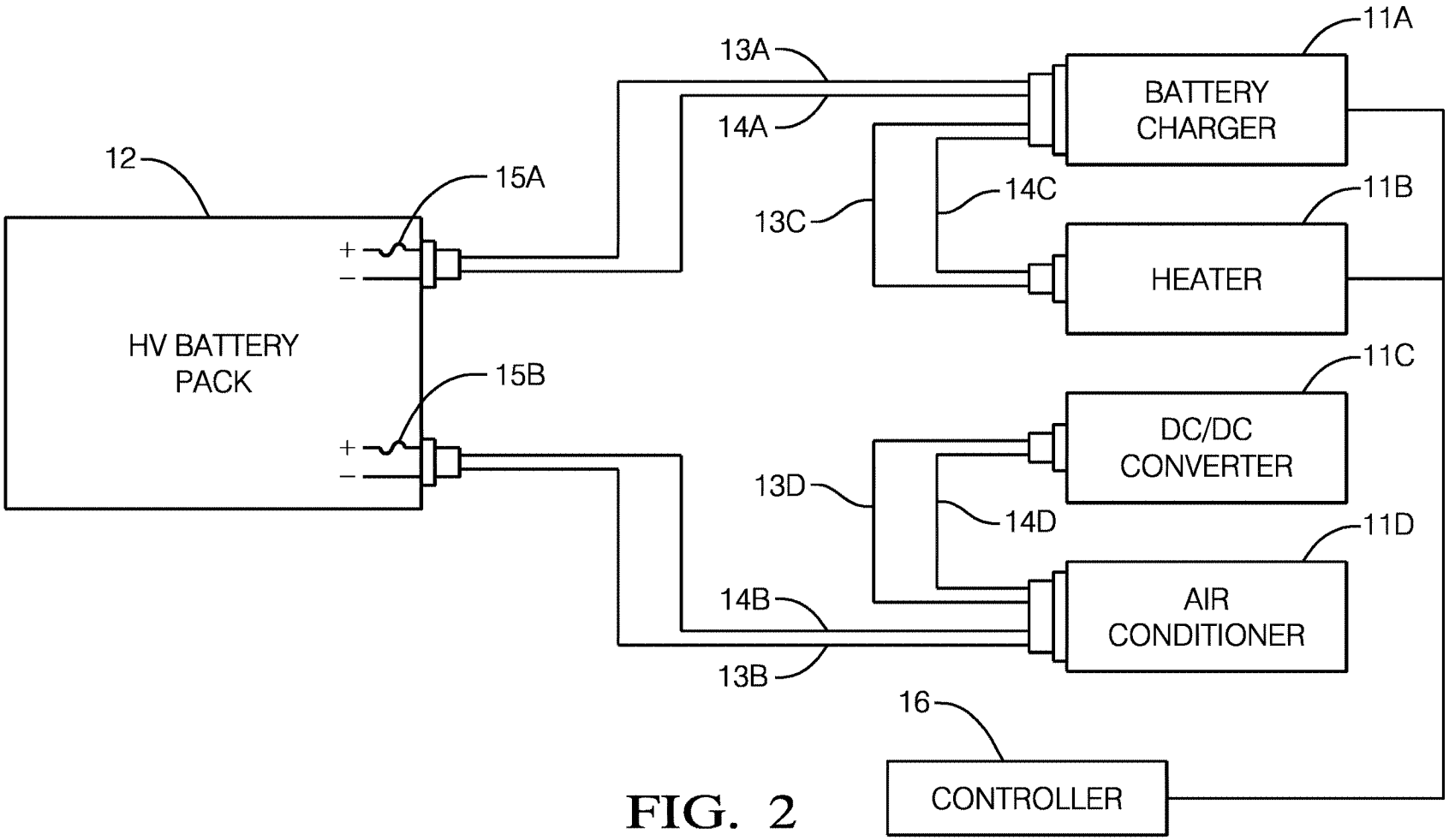
FIG. 2 is a schematic diagram of an electrical load connection scheme in accordance with one embodiment.

FIG. 2 illustrates a non-limiting example of a scheme for connecting electrical loads, e.g. a battery charger 11A, a heater 11B, a DC/DC convertor 11C, and an air conditioner (AC) compressor motor 11D, to a battery pack 12, such as in an electric vehicle (not shown) by splicing a pair of positive cables 13A, 13C, 13B, 13D and a pair of negative cables 14A, 14C, 14B, 14D using the devices and methods presented herein. The inventors discovered that several circuits may be combined and share a single fuse 15, for example because the combined current of the electrical loads 11A-B and/or 11C-D is lower than the rated capacity of the fuse 15 or because the electrical loads are not used concurrently. The electrical loads 11A-B may also be connected to a controller 16 that enables the electrical loads 11A-B to operate one at a time so that they are not used concurrently or the controller 16 may monitor the current used by each of the electrical loads 11A-B and control each of the electrical loads 11A-B so that the total current used by the electrical loads 11A-B is less than the current rating required to blow, or open, the fuse 15B.

Figure 1:
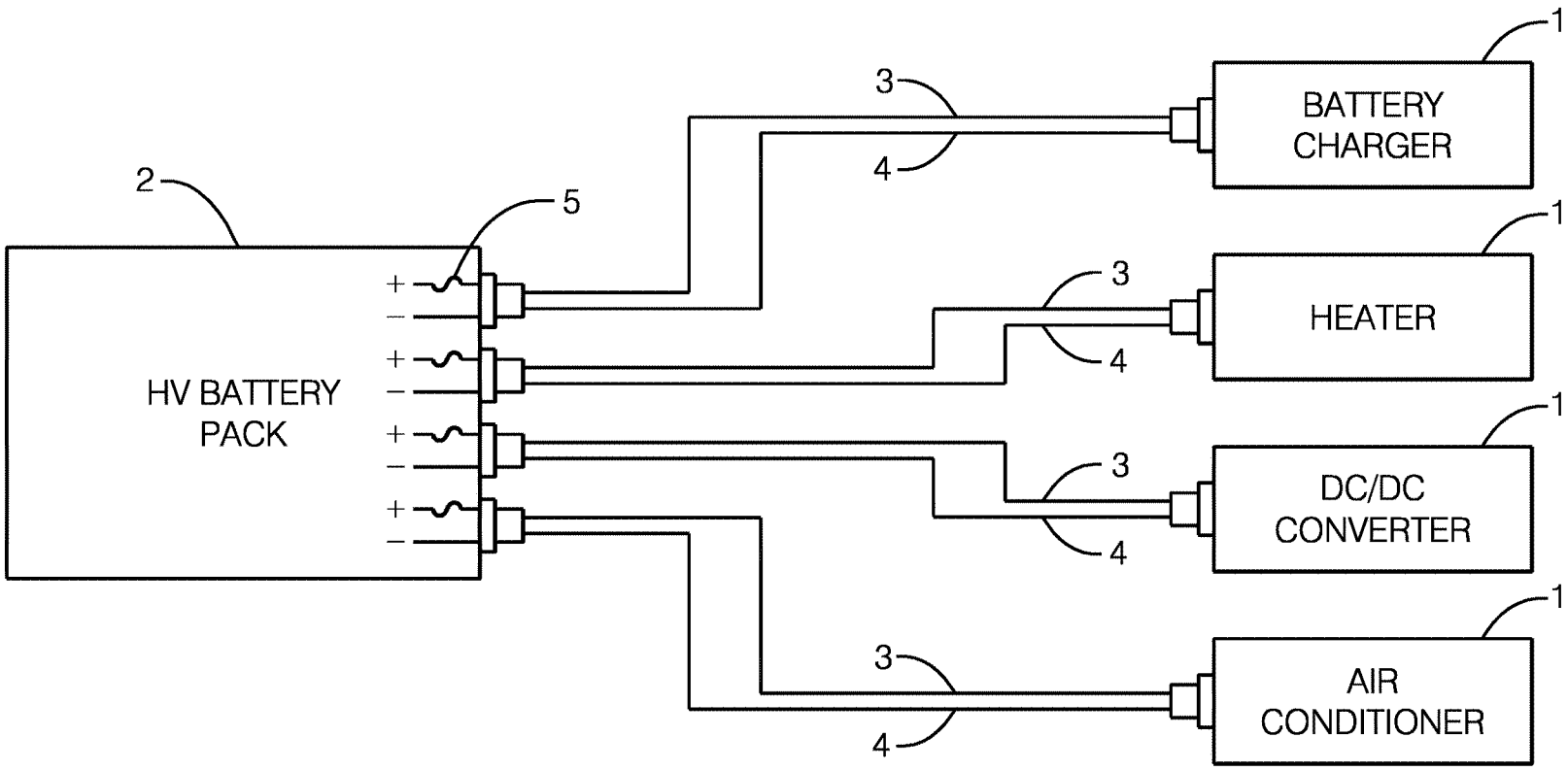
PRIOR ART FIG. 1
FIG. 1 is a schematic diagram of a prior art electrical load connection scheme.

The inventors realized that a pair of high voltage shielded wire cables 13A, 13C, 14A, 14C to these electrical loads could be spliced together as shown in FIG. 2 with an electrical connection system 20 that connects the core conductors of the shielded wire cables 13A, 13C, 14A, 14C while maintaining isolation and continuity of the shield conductors (not shown) of the shielded wire cables 13A, 13C, 14A, 14C, thereby reducing the total length of shielded wire cable required to interconnect the electrical loads 11A-D to the battery pack 12, thus reducing shielded wire cable cost, weight, packaging space, and wire routing complexity for the wiring harness. Because multiple electrical loads 11A-B, 11C-D can share a single fuse 15A, 15B, the number of fused circuits in the battery pack 12 could also be reduced; further reducing cost and complexity of the battery pack by reducing the number of fuses and cable connectors compared with the prior art scheme of FIG. 1 described in the BACKGROUND OF THE INVENTION.

Figure 3:
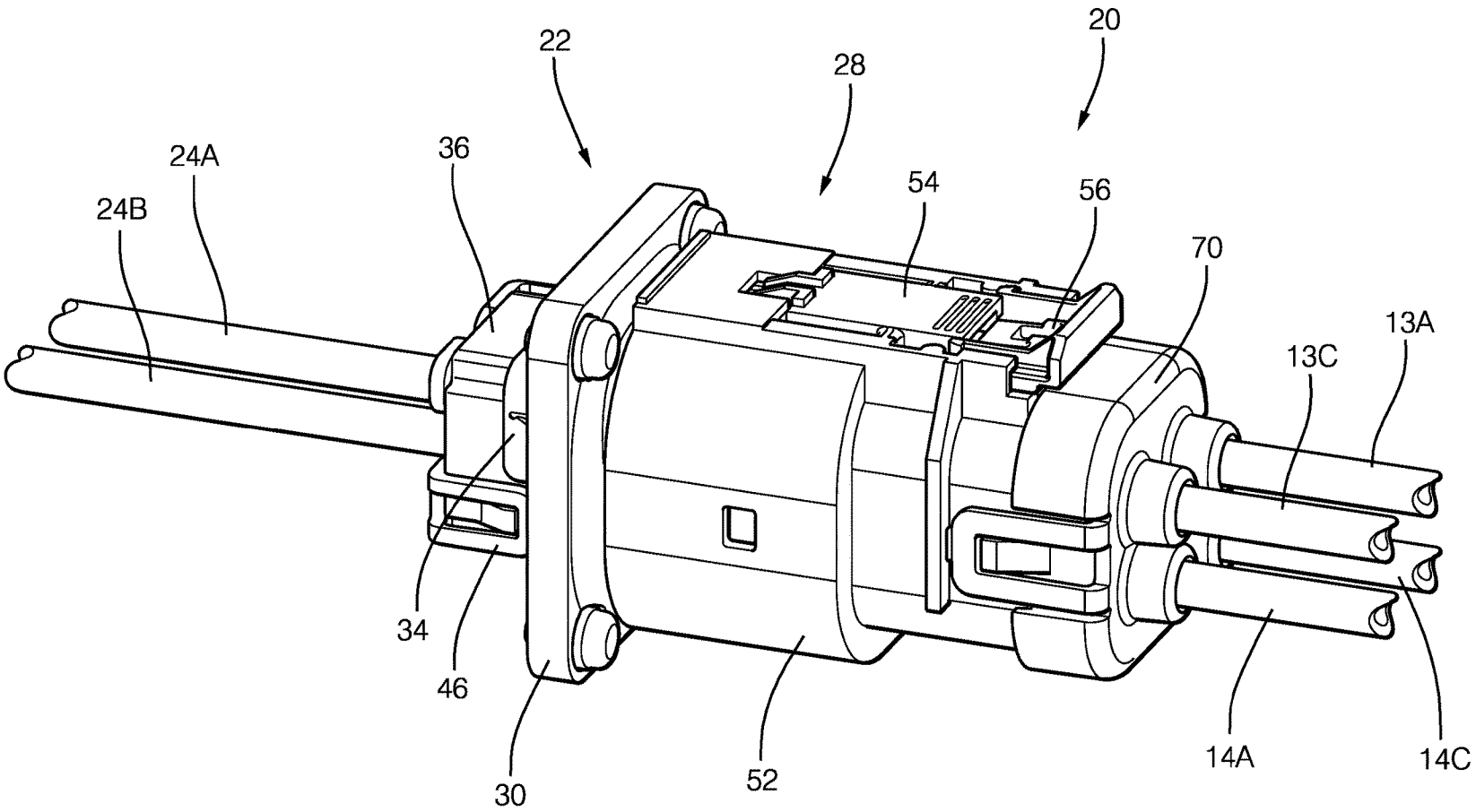
FIG. 3 is a perspective view of an electrical connector system according to one embodiment.
Figure 4:
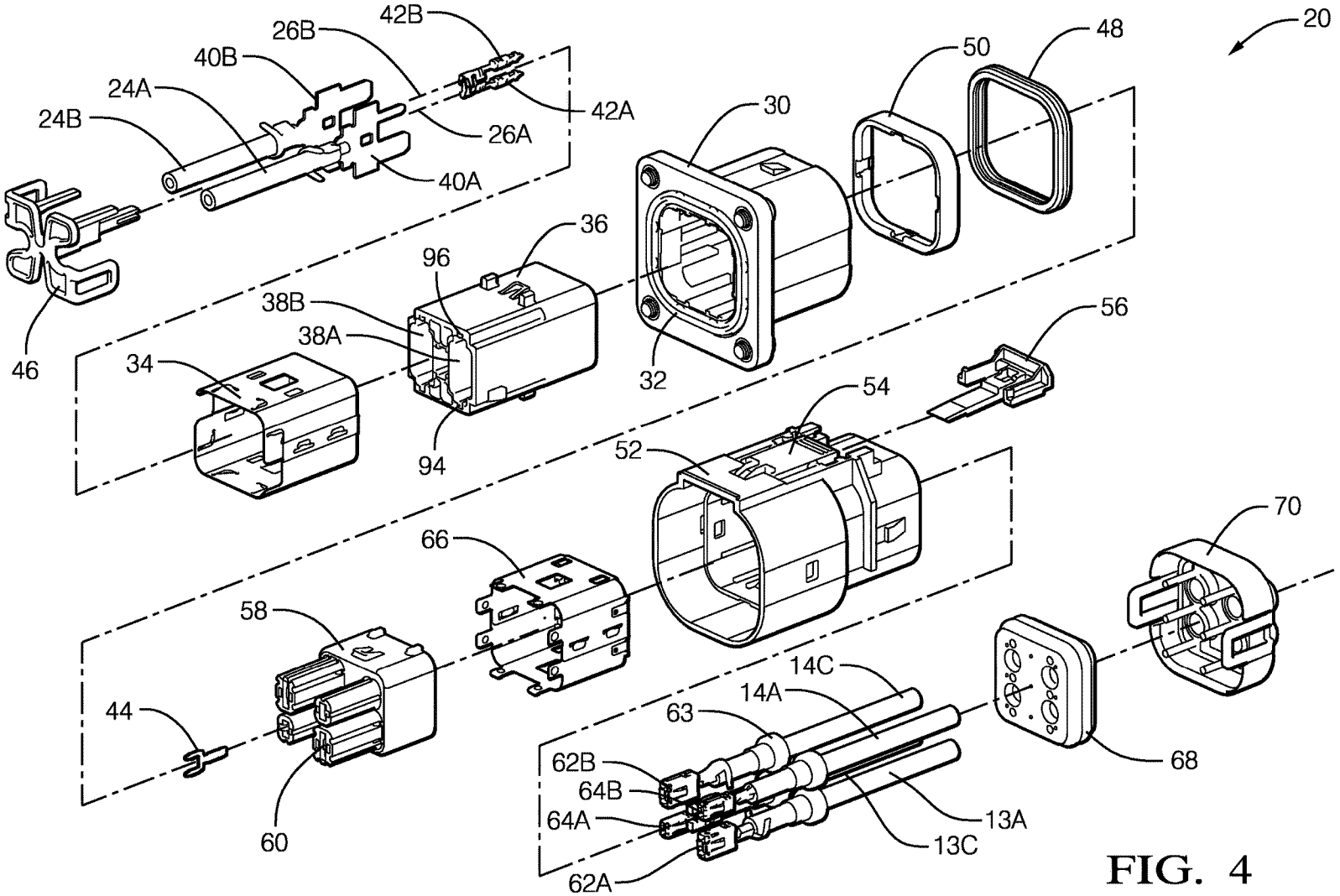
FIG. 4 is an exploded perspective view of the electrical connector system of FIG. 3 according to one embodiment.

FIGS. 2 through 4 illustrate a non-limiting example of the electrical connection system 20, hereinafter referred to as the connection system 20. The connection system 20 is configured to interconnect a battery pack 12 in an electric vehicle to two different electrical loads, such as a DC/DC convertor 11C and air conditioner (AC) compressor motor 11D. The connection system 20 includes a male connector 22 having two pairs of wire cables 24A-B, 26A-B and a female connector 28 having two pairs of shielded wire cables 13A, 13C, 14A, 14C. The male connector 22 has a male header 30 formed of an insulative material, such as glass filled polybutylene terephthalate (PBT), that is configured to be mounted to a conductive case (not shown) of one of the electrical loads, e.g. the DC/DC convertor 11C via fasteners, e.g. screws. The male header 30 includes a face seal 32 that is formed of a compliant elastomeric material and configured to seal the male header 30 to the conductive case thus inhibiting the intrusion of contaminants into the connection system 20 and the conductive case.

The male connector 22 includes a conductive male shield 34 within the male header 30. This male shield 34 is electrically connected to the conductive case to provide an electrical connection between the shield conductors of the shielded wire cables 13A, 13C, 14A, 14C and the conductive case. The male shield 34 surrounds a male inner connector housing 36 formed of an insulating material, such as glass filled PBT, that is also disposed within the male header 30. This male inner connector housing 36 defines a number of cavities 38 that accept a pair of male power terminals 40A-B and female high voltage interlock (HVIL) terminals 42A-B.

The pair of male power terminals 40A-B terminate a first pair of wire cables 24A-B that supply electrical power from the connector system 20 to the DC/DC convertor 11C. This first pair of wire cables 24A-B does not need to be shielded because they are shielded by being contained within the conducive case of the DC/DC convertor 11C. The female HVIL terminals 42A-B are connected to a second pair of wire cables 26A-B that are interconnected with an HVIL control circuit (not shown). The HVIL control circuit inhibits operation of the DC/DC convertor 11C until the female HVIL terminals 42A-B are shorted together by a shunt terminal 44 in the female connector 28.

The male connector 22 further includes a terminal position assurance (TPA) device 46 formed of an insulative material, such as glass filled PBT, that is configured to secure the male power terminals 40A-B and female HVIL terminals 42A-B within the male inner connector housing 36. The male connector 22 additionally includes a compliant connector seal 48 and seal retainer 50 configured to seal the male connector 22 to the female connector 28, thereby inhibiting contaminants from entering the connection system 20.

The female connector 28 includes an outer connector housing 52 formed of an insulative material, e.g. glass filled PBT, that defines a locking arm 54 designed to secure the female connector 28 to the male connector 22 and a connector position assurance (CPA) device 56 that assures that the locking arm 54 cannot be activated to disconnect the male connector 22 from the female connector 28 unless the CPA device 56 is disengaged first.

The female connector 28 further includes a female inner connector housing 58 formed of an insulative material, such as glass filled PBT. The female inner connector housing 58 also defines a number of cavities 60 that are configured to accept two pairs of female power terminals 62A-B, 64A-B. A first pair of female power terminals 62A-B terminate the center conductors of a first pair of shielded wire cables 13A, 14A connected to the electrical vehicle battery pack 12 and a second pair of female power terminals 64A-B terminate the center conductors of a second pair of shielded wire cables 13C, 14C connected to a second electrical load, e.g. the AC compressor motor 11D. The center conductors of the first pair of shielded wire cables 13A, 14A have a larger cross section than the center conductors of the second pair of shielded wire cables 13C, 14C in order to allow the first shielded wire cables 13A, 14A to conduct a larger current from the battery pack 12 to both of the electrical loads 11C-D, wherein the second pair of shielded wire cables 13C, 14C carries a lower current from the DC/DC converter 11C to the AC compressor motor 11D. The outer shield conductors of the first and second pair of shielded wire cables 13A, 13C, 14A, 14C are terminated by conductive ferrules 63 that are interconnected to a conductive female shield 66 that surrounds the female inner connector housing 58. When the male connector 22 is mated with the female connector 28, the female shield 66 is interconnected to the male shield 34, thereby providing electrical shielding of the male and female power terminals 40A-B, 60A-B, 62A-B and electrical continuity between the shield conductors and the conductive case.

The female inner connector housing 58 also includes the conductive HVIL shunt terminal 44 that is configured to interconnect the female HVIL terminals 42A-B after the male and female power terminals 40A-B, 60A-B, 62A-B are properly connected. The HVIL shunt terminal 44 and female HVIL terminals 42A-B are configured so that they mate last and break first when the male and female connectors 22, 28 are being connected and disconnected respectively.

The female connector 28 additionally includes a cable seal 68 formed of a compliant elastomeric material that surrounds each of the shielded wire cables 13A, 13C, 14A, 14C to inhibit contaminants from flowing into the connection system 20. The female connector 28 includes a strain relief device 70 as well. The strain relief device 70 is formed of an insulative material, such as a polyester compound. The strain relief device 70 retains the cable seal 68 within the outer connector housing 52 and affords terminal position assurance for the female power terminals 40A-B, 42A-B as well as providing strain relief for the shielded wire cables 13A, 13C, 14A, 14C.

Figure 5:
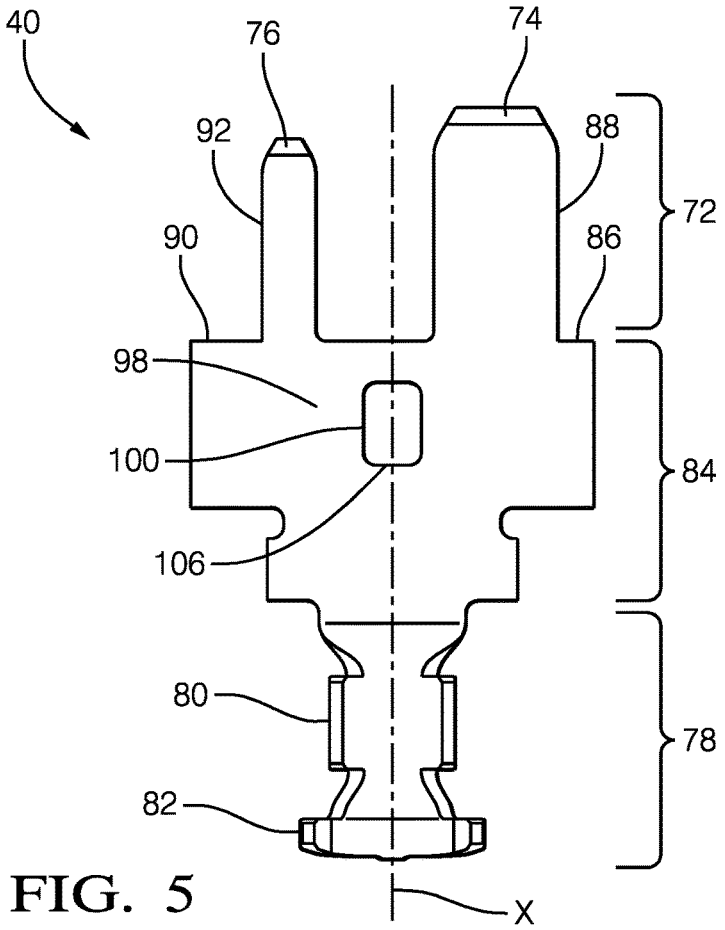
FIG. 5 is a side view of a male power terminal of the electrical connector system of FIG. 3 according to one embodiment.

As shown in FIG. 5, the male power terminal 40 includes a connection portion 72 that defines two blade-like features 74, 76 that each project from the terminal 40 parallel to the longitudinal axis X of the terminal 40. The male power terminal 40 also includes an attachment portion 78 that defines a first pair of crimp wings 80 configured to attach the terminal 40 to the conductor of the wire cable 24 and a second pair of crimp wings 82 configured to attach the terminal 40 to the insulation jacket of the wire cable 24. The male power terminal 40 further includes a transition portion 84 intermediate the connection portion 72 and the attachment portion 78. The male power terminal 40 is formed of a sheet of conductive material, such as a C151 copper alloy by a stamping or blanking process.

The first blade 74 of the male terminal 40 is wider than the second blade 76 to allow it to conduct a higher current from the battery pack 12 in order to supply power to both electrical loads at the same time, e.g. the DC/DC convertor 11C and the AC compressor motor 11D. In the illustrated example, the first blade 74 is 6.3 millimeters (mm) wide while the second blade 76 is 2.6 mm wide. The first blade 74 is also longer than the second blade 76 to allow it to interconnect with the first female power terminal 62 prior to connection of the second blade 76 with the second female power terminal 64. In the illustrated example, the first blade 74 projects 10.3 mm beyond the transition portion 84 while the second blade 76 projects 8.8 mm beyond the transition portion 84. This staggered arrangement of the first and second blades 74, 76 reduces the peak force required to mate the male and female connectors 22, 28. In the illustrated embodiment of the connection system 20, the maximum engage forces is less than 70 newtons. The tips of the first and second blades 74, 76 are beveled in two axes.

The first and second blades 74, 76 are covered in a silver-based plating while the attachment portion 78 is covered by a nickel-based plating to improve inter-terminal conductivity and inhibit corrosion. As best shown in FIG. 4, two male power terminals 40A-B are disposed within the male inner connector housing 36 and arranged such that the first and second blades 74A, 76A of one male power terminal 40A are non-adjacent or at a diagonal to the corresponding blades of the other male power terminal 40B. The first female power terminals 62A-B are also wider than the second female power terminals 64A-B in order to properly accommodate the first and second male power terminals 40A-B.

The transition portion 84 of each male power terminal 40 defines a first shoulder 86 that projects laterally, i.e. substantially perpendicularly to the longitudinal axis X of the male power terminal 40, from a first mesial or outer edge 88 of the first blade 74. The transition portion 84 of each male power terminal 40 also defines a second shoulder 90 that projects laterally from a second mesial edge 92 of the second blade 76 that is opposite the first mesial edge 88 of the first blade 74. A width of the first shoulder 86 is greater than a width of the second shoulder 90. As best shown in FIG. 4, these first and second shoulders 86, 90 interface with a shallower and deeper slots 64, 96 in opposite sides of the male inner connector housing 36. A lateral edge of the first shoulder is configured to engage an end wall of the first slot and a lateral edge of the second shoulder is configured to engage another end wall of the second slot to ensure that the male power terminals 40A-B are properly arranged in the male inner connector housing 36 as described above.

Figure 6:
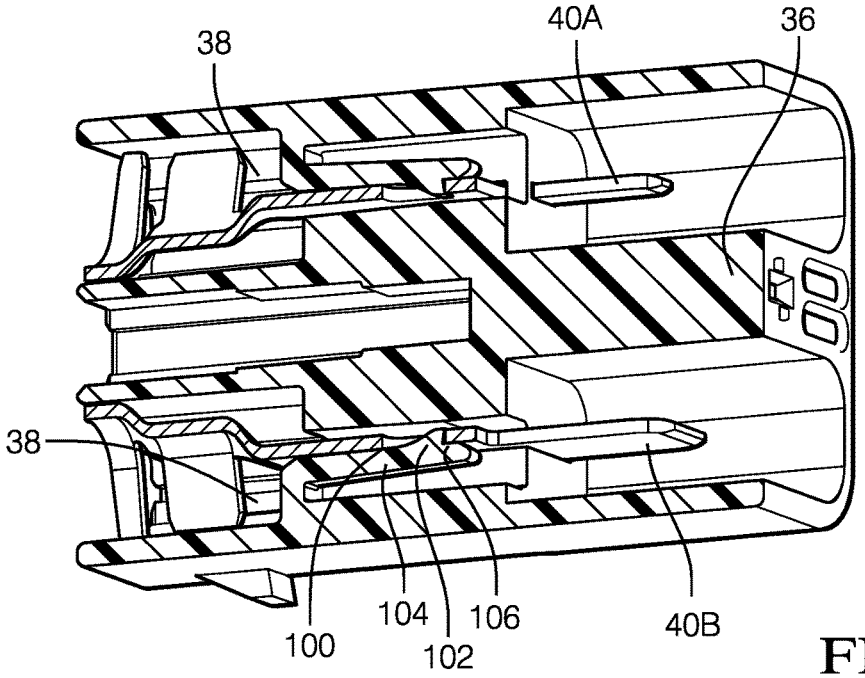
FIG. 6 is a cut away perspective view of the male power terminal of FIG. 5 secured within an inner housing of the electrical connector system of FIG. 3 according to one embodiment.

FIG. 5 shows that a distal or central region 98 of the transition portion 84 defines an aperture 100. This aperture 100 is characterized as having a generally rectangular shape. As shown in FIG. 6, a lock feature 102 defined by a flexible beam 104 within the male inner connector housing 36 engages an edge 106 of the aperture 100 and secures the male power terminal 40 within the male inner connector housing 36. The lock features is located within the cavity to ensure that the lateral edge of the first shoulder is engaged with the end wall of the first slot and the lateral edge of the second shoulder is engaged with the end wall of the second slot.

Without subscribing to any particular theory of operation, when the connection system 20 is fully connected, electrical current from the battery pack 12 flows through the first pair of shielded power cables to the electrical connector connection system 20 via the first female power terminals 40A-B. A portion of the current then flows to the DC/DC convertor 11C through the pair wire cables 24A-B joined to the attachment portions of the male power terminals 40A-B and the remaining portion of the current flows to the ac compressor motor 11D through the second pair of shielded cables 13C, 14C via the second blade 76.

While the electrical connector connection system 20 in the illustrated embodiment is used in an electric vehicle application, other embodiments of the system may be envisioned for other applications for splicing shielded wire cables. For example, the male connector may not be mounted to a conductive case and the male shield may be configured to interconnect to a shielded cable using ferrules 63 similarly to the female shield 66. In addition, while the illustrated electrical connector connection system 20 is configured to splice connect pairs of wire cables, other embodiments may be proposed to splice single wire cables.

Accordingly, an electrical connector connection system 20 configured to provide electrical power to two different electrical loads and a method of splicing a plurality of shielded wire cable pairs 13A, 13C, 14A, 14C are provided. The electrical connector connection system 20 provides a shielded wire cable splice that is sealed from environmental contamination. The male and female connectors 22, 28 of the may be interconnected with a force of less than 75 newtons, eliminating the need to a mechanical assist to meet ergonomic requirements imposed by may automotive manufacturers. The electrical connection system 20 also reduces the length of shielded cables 13A, 13C, 14A, 14C required to interconnect multiple electrical loads 11C, 11D with the battery pack 12, providing the benefit of reduced material cost and simplified cable routing.

While this invention has been described in terms of the preferred embodiments thereof, it is not intended to be so limited, but rather only to the extent set forth in the claims that follow. Moreover, the use of the terms first, second, etc. does not denote any order of importance, but rather the terms first, second, etc. are used to distinguish one element from another. Furthermore, the use of the terms a, an, etc. do not denote a limitation of quantity, but rather denote the presence of at least one of the referenced items.

We claim:

1. A male electrical terminal, comprising:

a connection portion that defines a first blade longitudinally projecting from said terminal and a second blade longitudinally projecting from said terminal, wherein a first blade width is less than a second blade width and wherein a first blade length is less than a second blade length;

an attachment portion that defines a pair of crimp wings configured to attach said terminal to a wire cable; and a transition portion intermediate the connection portion and the attachment portion, wherein the transition portion defines a first shoulder laterally projecting from a first mesial edge proximate the first blade and wherein the transition portion defines a second shoulder laterally projecting from a second mesial edge opposite the first mesial edge and proximate the second blade.

2. The male electrical terminal according to claim 1, wherein a first shoulder width is greater than a second shoulder width.

3. The male electrical terminal according to claim 1, wherein a distal region of the transition portion defines an aperture.

4. The male electrical terminal according to claim 3, wherein the aperture is characterized as having a rectangular shape.

5. An electrical connector system, comprising:

a male connector having a male terminal that defines a first blade longitudinally projecting from the male terminal and a second blade longitudinally projecting from said male terminal, wherein a first blade width is less than a second blade width and wherein a first blade length is less than a second blade length, said male terminal further defines a pair of crimp wings configured to attach the male terminal to a wire cable; and a female connector having a first female terminal configured to receive the first blade and a second female terminal configured to receive the second blade, thereby electrically interconnecting the first female terminal, the second female terminal, and the wire cable.

6. The electrical connector system according to claim 5, wherein the first blade defines a first shoulder laterally projecting from a mesial edge of the first blade and wherein the second blade defines a second shoulder laterally projecting from another mesial edge of the second blade.

7. The electrical connector system according to claim 6, wherein a first shoulder width is greater than the second shoulder width.

8. The electrical connector system according to claim 7, further comprising a male connector body defining a cavity configured to receive the male terminal, wherein the cavity defines a first longitudinal slot configured to receive the first shoulder and defines a second longitudinal slot opposite the first slot, said second slot having a second slot depth less than a first slot depth and configured to receive the second shoulder and wherein a lateral first shoulder edge is configured to engage an end wall of the first slot and a lateral second shoulder edge is configured to engage an end wall of the second slot.

9. The electrical connector system according to claim 8, wherein a distal region of the male terminal defines an aperture and wherein the male connector body defines a snap feature configured to engage the aperture.

10. The electrical connector system according to claim 9, wherein the aperture is characterized as having a rectangular shape.

11. An electrical connector system, comprising:

a male connector having a male terminal that defines a first blade longitudinally projecting from the male terminal and a second blade longitudinally projecting from said male terminal, wherein a width of the first blade is less than a width of the second blade, said male terminal further defines a pair of crimp wings configured to attach the male terminal to a wire cable; and a female connector having a first female terminal configured to receive the first blade and a second female terminal configured to receive the second blade, wherein a first tip of the first blade has a first relative position and a second tip of the second blade has a second relative position that is different than the first relative position such that as the male connector is mated with the female connector, thereby electrically interconnecting the first female terminal, the second female terminal, and the wire cable, the first tip does not contact the first female terminal at the same time that the second tip contacts the second female terminal, thereby lowering a peak engagement force required to mate the male connector with the female connector.

12. The electrical connector system according to claim 11, wherein the peak engagement force required for mating the male connector with the female connector does not exceed 75 newtons.

13. The electrical connector system according to claim 11, wherein the first blade defines a first shoulder laterally projecting from a mesial edge of the first blade and wherein the second blade defines a second shoulder laterally projecting from a mesial edge of the second blade.

14. The electrical connector system according to claim 13, wherein a first shoulder width is greater than a second shoulder width.

15. The electrical connector system according to claim 14, further comprising a male connector body defining a cavity configured to receive the male terminal, wherein the cavity defines a first longitudinal slot configured to receive the first shoulder and defines a second longitudinal slot opposite the first slot, said second slot having a second slot depth less than a first slot depth and configured to receive the second shoulder and wherein a lateral first shoulder edge is configured to engage an end wall of the first slot and a lateral second shoulder edge is configured to engage an end wall of the second slot.

16. The electrical connector system according to claim 15, wherein a distal region of the male terminal defines an aperture and wherein the male connector body defines a snap feature configured to engage the aperture.

17. The electrical connector system according to claim 16, wherein the aperture is characterized as having a rectangular shape.

* * * * *